US009870747B2

(12) United States Patent
Park et al.

(10) Patent No.: US 9,870,747 B2
(45) Date of Patent: Jan. 16, 2018

(54) DISPLAY DEVICE

(71) Applicant: Samsung Display Co., Ltd., Yongin, Gyeonggi-do (KR)

(72) Inventors: Dong-Won Park, Hwaseong-si (KR); Jung-Won Kim, Seoul (KR)

(73) Assignee: Samsung Display Co., Ltd., Gyeonggi-Do (KR)

( * ) Notice: Subject to any disclaimer, the term of this patent is extended or adjusted under 35 U.S.C. 154(b) by 150 days.

(21) Appl. No.: 14/693,316

(22) Filed: Apr. 22, 2015

(65) Prior Publication Data

US 2015/0348492 A1 Dec. 3, 2015

(30) Foreign Application Priority Data

Jun. 2, 2014 (KR) ..... 10-2014-0067100

(51) Int. Cl.
*G09G 3/36* (2006.01)
*G09G 3/3225* (2016.01)
(Continued)

(52) U.S. Cl.
CPC ..... *G09G 3/3677* (2013.01); *G09G 3/3666* (2013.01); *G09G 3/3225* (2013.01); *G09G 3/3275* (2013.01); *G09G 3/344* (2013.01); *G09G 3/3696* (2013.01); *G09G 2300/04* (2013.01); *G09G 2310/027* (2013.01);
(Continued)

(58) Field of Classification Search
CPC ..... G09G 2370/08; G09G 2320/0276; G09G 2310/027; G09G 2310/0221; G09G 3/3696; G09G 3/3677; G09G 3/3666; G09G 3/344; G09G 3/3275; G09G 3/3225; G09G 2320/0223; G09G 2300/04; G09G 5/00
See application file for complete search history.

(56) References Cited

U.S. PATENT DOCUMENTS 6,429,841 B1 * 8/2002 Lee ..... G09G 3/3648 345/208
7,876,303 B2 1/2011 Moon et al.
(Continued)

FOREIGN PATENT DOCUMENTS

KR 10-2010-0123269 A 11/2010
KR 10-2011-0017280 A 2/2011
KR 10-2013-0044771 A 5/2013

*Primary Examiner* — Alexander Eisen
*Assistant Examiner* — Abhishek Sarma
(74) *Attorney, Agent, or Firm* — Knobbe Martens Olson & Bear LLP

(57) ABSTRACT

A display device is disclosed. In one aspect, the display device includes a display panel divided into first and second display parts. The display device also includes a first driving circuit configured to receive a driving voltage, generate a first gamma reference voltage based on the driving voltage, generate a first data signal based on the first gamma reference voltage, and apply the first data signal to the first display part. The display device further includes a second driving circuit configured to apply a second data signal to the second display part and a first share line disposed on the display panel. The first share line is configured to receive the first gamma reference voltage. The second driving circuit is further configured to receive the first gamma reference voltage from the first share line and generate the second data signal based on the first gamma reference voltage.

13 Claims, 9 Drawing Sheets

(51) Int. Cl.
*G09G 3/3275* (2016.01)
*G09G 3/34* (2006.01)

(52) U.S. Cl.
CPC ..... *G09G 2310/0221* (2013.01); *G09G 2320/0223* (2013.01); *G09G 2320/0276* (2013.01); *G09G 2370/08* (2013.01)

(56) References Cited

U.S. PATENT DOCUMENTS

| | | | | |
|---|---|---|---|---|
| 8,223,103 | B2 | 7/2012 | Kim et al. | |
| 8,259,047 | B2 | 9/2012 | Kim et al. | |
| 2004/0233182 | A1* | 11/2004 | Chuang | G09G 3/3611 345/204 |
| 2006/0164354 | A1* | 7/2006 | Lee | G02F 1/136213 345/89 |
| 2007/0182683 | A1* | 8/2007 | Chin | G09G 3/3688 345/88 |
| 2009/0135116 | A1* | 5/2009 | Chang | G09G 3/3696 345/87 |
| 2010/0321362 | A1* | 12/2010 | Weng | G09G 3/3688 345/211 |
| 2012/0140160 | A1 | 6/2012 | Han et al. | |
| 2013/0300773 | A1* | 11/2013 | Kim | G09G 5/10 345/690 |
| 2014/0204065 | A1 | 7/2014 | Park et al. | |
| 2015/0187321 | A1* | 7/2015 | Kim | G09G 3/3696 345/87 |

* cited by examiner

DISPLAY DEVICE

CROSS-REFERENCE TO RELATED APPLICATIONS

This U.S. non-provisional patent application claims priority under 35 U.S.C. §119 of Korean Patent Application No. 10-2014-0067100, filed on Jun. 2, 2014, the entire contents of which are hereby incorporated by reference.

BACKGROUND

Field

The described technology generally relates to a display device, and more particularly, to a large-sized display device.

Description of the Related Technology

Display devices include a display panel that displays images and a driving circuit that drives the display panel. The driving circuit includes a timing controller, a gate driver that provides a gate signal to the display panel, and a data driver that provides a data signal to the display panel. Additionally, the driving circuit further includes a gamma voltage generator that generates a gamma voltage and applies the gamma voltage to the gate and data drivers.

As display devices are manufactured with larger areas, a plurality of driving circuits can be used to ensure fast driving (i.e., minimizing signal delay) of the display panel. Each of the driving circuits is separately driven.

SUMMARY OF CERTAIN INVENTIVE ASPECTS

One inventive aspect is a large-sized display device where a boundary between display parts is not visible.

Another aspect is a display device including: a display panel including a first display unit and a second display unit adjacent to each other; a first driving block generating a first gamma reference voltage by receiving driving voltage, generating a first data signal based on the first gamma reference voltage, and outputting the first data signal to the first display unit; a second driving block outputting a second data signal to the second display unit; and a first share line receiving the first gamma reference voltage and disposed on the display panel, wherein the second driving block generates the second data signal based on a gamma reference voltage received from the first share line.

In some embodiments, the second driving block may include: a compensation voltage generation unit generating a compensation gamma reference voltage corresponding to a level of the first gamma reference voltage based on the received gamma reference voltage; and a second data driver generating the second data signal based on the compensation gamma reference voltage.

In other embodiments, the compensation voltage generation unit may include: a voltage generation unit generating the second gamma reference voltage; and a feedback circuit outputting a feedback signal by feeding back a level difference between a gamma reference voltage received from the first share line and the second gamma reference voltage.

In still other embodiments, the received gamma reference voltage may include a positive first reference voltage, a positive second reference voltage, a negative first reference voltage, and a negative second reference voltage.

In even other embodiments, the received gamma reference voltage may further include positive reference voltages having a level between levels of the positive first reference voltage and the positive second reference voltage and negative reference voltages having a level between levels of the negative first reference voltage and the negative second reference voltage.

In yet other embodiments, the second data driver may generate the second data signal based on the positive first reference voltage, the positive second reference voltage, the positive reference voltages, the negative first reference voltage, the negative second reference voltage, and the negative reference voltages.

In further embodiments, the compensation voltage generation unit may further include a voltage distribution unit generating positive reference voltages based on the positive first reference voltage and the positive second reference voltage and generating negative reference voltages based on the negative first reference voltage and the negative second reference voltage.

In still further embodiments, the second gamma reference voltage may be generated based on the driving voltage provided from the first driving block through the first share line.

In even further embodiments, the display devices may further include at least one buffer unit buffering the first gamma reference voltage applied to the first share line, wherein the first share line may include a first sub-share line connecting the first driving block and the buffer unit and a second sub-share line connecting the buffer unit and the second driving block.

In yet further embodiments, the buffer unit may be disposed on the display panel.

In yet further embodiments, the display devices may further include: a third driving block adjacent to the second display unit in a vertical direction and outputting a third data signal to a third display unit; and a second share line connecting the second driving block and the third driving block and disposed on the display panel, wherein the third driving block may generate a second compensation gamma reference voltage corresponding to a level of the first gamma reference voltage on the basis a gamma reference voltage received through the second share line and may generate the third data signal based on the second compensation gamma reference voltage.

In yet further embodiments, the second driving block may further include a second gate driver outputting a gate signal to the second display unit; the third driving block further includes a third gate driver outputting a gate signal to the third display unit; and the second share line is disposed on the display panel and is adjacent to the second gate driver and the third gate driver.

In yet further embodiments, the display devices may further include at least one buffer unit buffering a gamma reference voltage applied to the second share line, wherein the second share line may include a first sub-share line connecting the second driving block and the buffer unit and a second sub-share line connecting the buffer unit and the third driving block.

In yet further embodiments, a voltage level of the second compensation gamma reference voltage may be substantially identical to a voltage level of the first gamma reference voltage when output from the gamma reference voltage generation unit of the first driving block.

Another aspect is a display device comprising a display panel divided into a first display part and a second display part disposed adjacent to the first display part; a first driving circuit configured to: i) receive a driving voltage, ii) generate a first gamma reference voltage based on the driving voltage, iii) generate a first data signal based on the first gamma reference voltage, and iv) apply the first data signal to the first display part; a second driving circuit configured to apply a second data signal to the second display part; and a first share line disposed on the display panel and configured to receive the first gamma reference voltage, wherein the second driving circuit is further configured to: i) receive the first gamma reference voltage from the first share line and ii) generate the second data signal based on the first gamma reference voltage.

In certain embodiments, the second driving circuit comprises a compensation voltage generator configured to generate a first compensation gamma reference voltage having a voltage level corresponding to that of the first gamma reference voltage based on the first gamma reference voltage; and a second data driver configured to generate the second data signal based on the first compensation gamma reference voltage. The compensation voltage generator can comprise a voltage generator configured to generate a second gamma reference voltage; and a feedback circuit configured to output a feedback signal based on the voltage difference between the first gamma reference voltage and the second gamma reference voltage. The first gamma reference voltage can further comprise: i) a plurality of positive reference voltages having voltage levels between those of the positive first reference voltage and the positive second reference voltage and ii) a plurality of negative reference voltages having voltage levels between those of the negative first reference voltage and the negative second reference voltage.

In certain embodiments, the second data driver is further configured to generate the second data signal based on the positive first reference voltage, the positive second reference voltage, the positive reference voltages, the negative first reference voltage, the negative second reference voltage, and the negative reference voltages. The compensation voltage generator can further comprise a voltage distributer configured to generate: i) a plurality of positive reference voltages based on the positive first reference voltage and the positive second reference voltage and ii) a plurality of negative reference voltages based on the negative first reference voltage and the negative second reference voltage. The first driving circuit can be further configured to output the driving voltage to the first share line and the voltage generator can be further configured to: i) receive the driving voltage from the first share line and ii) generate the second gamma reference voltage based on the driving voltage.

In certain embodiments, the display device further comprises at least one buffer configured to buffer the first gamma reference voltage, wherein the first share line comprises: i) a first sub-share line electrically connecting the first driving circuit to the buffer and ii) a second sub-share line electrically connecting the buffer to the second driving circuit. The buffer can be disposed on the display panel. The display panel can further comprise a third display part disposed adjacent to the second display part and the display device can further comprise a third driving circuit disposed adjacent to the third display part and opposing the second driving circuit with the display panel disposed therebetween, wherein the third driving circuit is configured to apply a third data signal to the third display part; and a second share line electrically connecting the second driving circuit to the third driving circuit, wherein the second share line is disposed on the display panel, and wherein the third driving circuit is further configured to: i) receive the first compensation gamma reference voltage from the second share line ii) generate a second compensation gamma reference voltage having a voltage level corresponding to that the first gamma reference voltage based on the first compensation gamma reference voltage and iii) generate the third data signal based on the second compensation gamma reference voltage.

In certain embodiments, the second driving circuit further comprises a second gate driver configured to apply a gate signal to the second display part, wherein the third driving circuit further comprises a third gate driver configured to apply a gate signal to the third display part, and wherein the second share line is adjacent to the second gate driver and the third gate driver.

In certain embodiments, the display device further comprises at least one buffer configured to buffer the first compensation gamma reference voltage applied to the second share line, wherein the second share line comprises: i) a first sub-share line electrically connecting the second driving circuit to the buffer and ii) a second sub-share line electrically connecting the buffer to the third driving circuit. The voltage level of the second compensation gamma reference voltage can be substantially the same as a voltage level of the first gamma reference voltage.

BRIEF DESCRIPTION OF THE DRAWINGS

The accompanying drawings are included to provide a further understanding of the described technology and are incorporated in and constitute a part of this specification. The drawings illustrate exemplary embodiments and, together with the description, serve to explain principles of the described technology. In the drawings.

DETAILED DESCRIPTION OF CERTAIN INVENTIVE EMBODIMENTS

Figure 1:
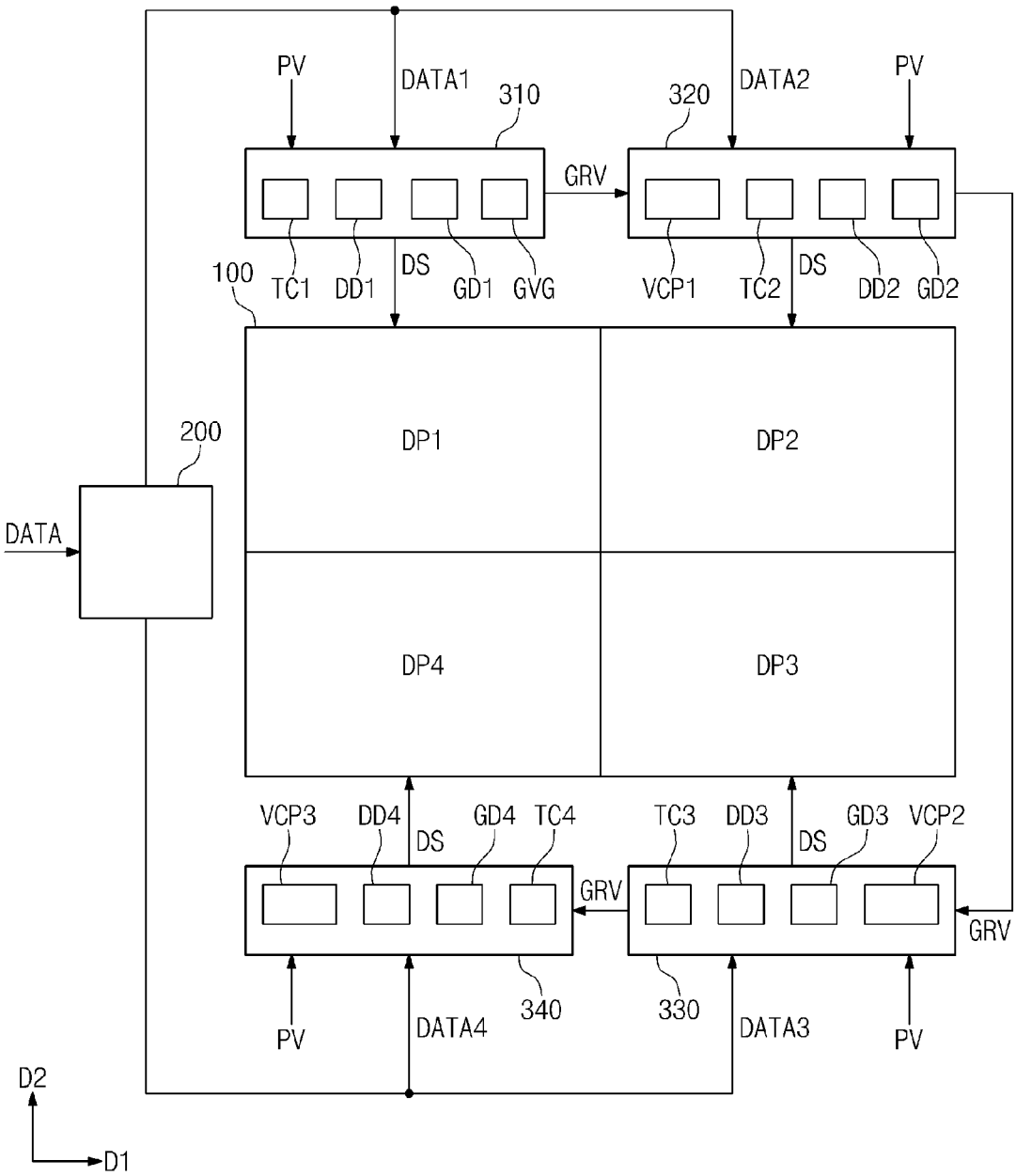
FIG. 1 is a block diagram illustrating a display device according to an embodiment.

FIG. 1 is a block diagram illustrating a display device according to an embodiment. Referring to FIG. 1, the display device includes a display panel 100, a data distributor 200, and driving blocks or driving circuits 310 to 340. In this embodiment, the driving blocks 310 to 340 include first to fourth driving blocks 310 to 340. The number of driving blocks 310 to 340 may vary depending on the embodiment.

The display panel 100 displays an image by receiving a driving signal DS from the first to fourth driving blocks 310 to 340. The display panel 100 is not limited to a specific type, and for example, may include a liquid crystal display (LCD) panel, an organic light-emitting diode (OLED) display panel, an electrophoretic display (EPD) panel, or an electrowetting display (EWD) panel.

The display panel 100 is divided into a plurality of display parts (hereinafter referred to as display parts or display units). In this embodiment, the display panel 100 is divided into first to fourth display parts DP1 to DP4. The first to fourth display parts DP1 to DP4 is arranged in a 4×4 matrix by dividing the display panel 100.

For example, the first display unit DP1 and the second display unit DP2 are adjacent to each other in a first direction D1 and the second display unit DP2 and the third display unit DP3 are adjacent to each other in a second direction D2 orthogonal to the first direction D1. Additionally, the fourth display unit DP4 and the third display unit DP3 are adjacent to each other in the first direction D1 and the fourth display unit DP4 and the first display unit DP1 are adjacent to each other in the second direction D2.

In some embodiments, each of the first to fourth display parts DP1 to DP4 is a separate panel. In other embodiments, the first to fourth display parts DP1 to DP4 are defined at an integrated panel divided into parts. A plurality of pixels (not shown) are disposed in each of the first to fourth display parts DP1 to DP4.

The data distributor 200 receives image data DATA from an external source and distributes the image data DATA to the first to fourth driving blocks 310 to 340. The data distributor 200 divides the image data DATA into first to fourth image data DATA1 to DATA4 respectively corresponding to the first to fourth driving blocks 310 to 340 and respectively outputs the first to fourth image data DATA1 to DATA4 to the driving blocks 310 to 340.

The first to fourth driving blocks 310 to 340 receive driving voltage PV and output the driving signal DS. The first to fourth driving blocks 310 to 340 receive the first to fourth image data DATA1 to DADTA4 and generate the driving signal DS based on the received driving voltage PV. Although not shown in the drawing, each of the first to fourth driving blocks 310 to 340 can receive an additional control signal.

The driving voltage PV is an analog voltage for driving components included in each of the first to fourth driving blocks 310 to 340 and the display panel 100. Although not shown in the drawing, the driving voltage PV can include a plurality of voltages having different levels.

In this embodiment, the driving voltage PV is separately provided from an external power to the first to fourth driving blocks 310 to 340. In other embodiments, the first driving block 310 receives the driving voltage PV from an external power and the second to fourth driving blocks 320 to 340 receive the driving voltage PV from the first driving block 310.

The driving signal DS is provided to the display panel 100, thereby displaying an image on the display panel 100. The driving signal DS includes a data signal and a gate signal. Each of the first to fourth driving blocks 310 to 340 provides a data signal and a gate signal to a corresponding display area in the first to fourth display parts DP1 to DP4. In certain embodiments, the data signal is an analog voltage corresponding to a grayscale value of corresponding image data and the gate signal is a pulse voltage for selecting the corresponding pixels.

Examining the first to fourth driving blocks 310 to 340 in more detail, each of the first to fourth driving blocks 310 to 340 includes a timing controller TC1 to TC4, a data driver DD1 to DD4, and a gate driver GD1 to GD4.

In the FIG. 1 embodiment, one timing controller TC1 to TC4 is provided for each of the first to fourth display parts DP1 to DP4. Accordingly, the timing controllers TC1 to TC4 include the first to fourth timing controllers TC1 to TC4 respectively corresponding to the first to fourth display parts DP1 to DP4.

Each of the first to fourth timing controllers TC1 to TC4 generates a data control signal and provides the data control signal to a corresponding one of the data drivers DD1 to DD4. The data control signal can include a horizontal start signal, a polarity reversal signal, and/or a load signal.

In the FIG. 1 embodiment, the data drivers DD1 to DD4 include the first to fourth data drivers DD1 to DD4 respectively corresponding to the first to fourth display parts DP1 to DP4. The first to fourth data drivers DD1 to DD4 respectively convert the first to fourth image data DATA1 to DATA4 into data signals and respectively provide the data signals to the first to fourth display parts DP1 to DP4.

Moreover, although FIG. 1 illustrates that the first to fourth timing controllers TC1 to TC4 and the first to fourth data drivers DD1 to DD4 have a one-to-one correspondence, the described technology is not limited thereto. Each of the first to fourth timing controllers TC1 to TC4 may correspond to a plurality of data drivers.

Additionally, each of the first to fourth timing controllers TC1 to TC4 generates a gate control signal based on the driving voltage PV and provides the gate control signal to a corresponding one of the gate drivers DD1 to DD4. However, the described technology is not limited thereto and the gate control signal may be provided from the data distributor 200 to one of the gate drivers GD1 to GD4. The gate control signal can include a vertical start signal and/or a gate clock signal.

The gate drivers GD1 to GD4 include first to fourth gate drivers GD1 to GD4 corresponding to the first to fourth display parts DP1 to DP4. Each of the first to fourth gate drivers GD1 to GD4 generates a gate signal based on the gate control signal and provides the generated gate signal to the display panel 100.

Accordingly, examining each of the first to fourth driving blocks 310 to 340 in more detail, the first driving block 310 includes a first timing controller TC1, a first data driver DD1, a first gate driver GD1, and a voltage generation unit or voltage generator GVG. The voltage generation unit GVG generates a gamma reference voltage (not shown) based on the received driving voltage PV. This will be described later.

The second driving block 320 includes a second timing controller TC2, a second data driver DD2, a second gate driver GD2, and a first compensation voltage generation unit or first compensation voltage generator VCP1. The first compensation voltage generation unit VCP1 generates a compensation voltage based on a gamma reference voltage received from the first driving block 310. This will be described later. In this embodiment, the third and fourth driving blocks 330 and 340 have the same configuration as the second driving block 320.

The first to fourth driving blocks 310 to 340 share a portion of voltages GRV (hereinafter referred to as share voltage). Although not shown in the drawing, the first and fourth driving blocks 310 and 340 may share the share voltage GRV.

The share voltage GRV includes at least a portion of a gamma reference voltage. As a gamma reference voltage generated from the first driving block 310 is provided to the second to fourth driving blocks 320 to 340, the first to fourth driving blocks 310 to 340 can generate a data signal based on substantially the same gamma reference voltage. Accordingly, data signals having the same grayscale value generated from the first to fourth driving blocks 310 to 340 have substantially the same level.

A display device according to the at least one embodiment includes a share line (not shown). The first to fourth driving blocks 310 to 340 are connected to each other via the share line. The share voltage GRV is a predetermined voltage that is distributed via the share line.

Figure 2:
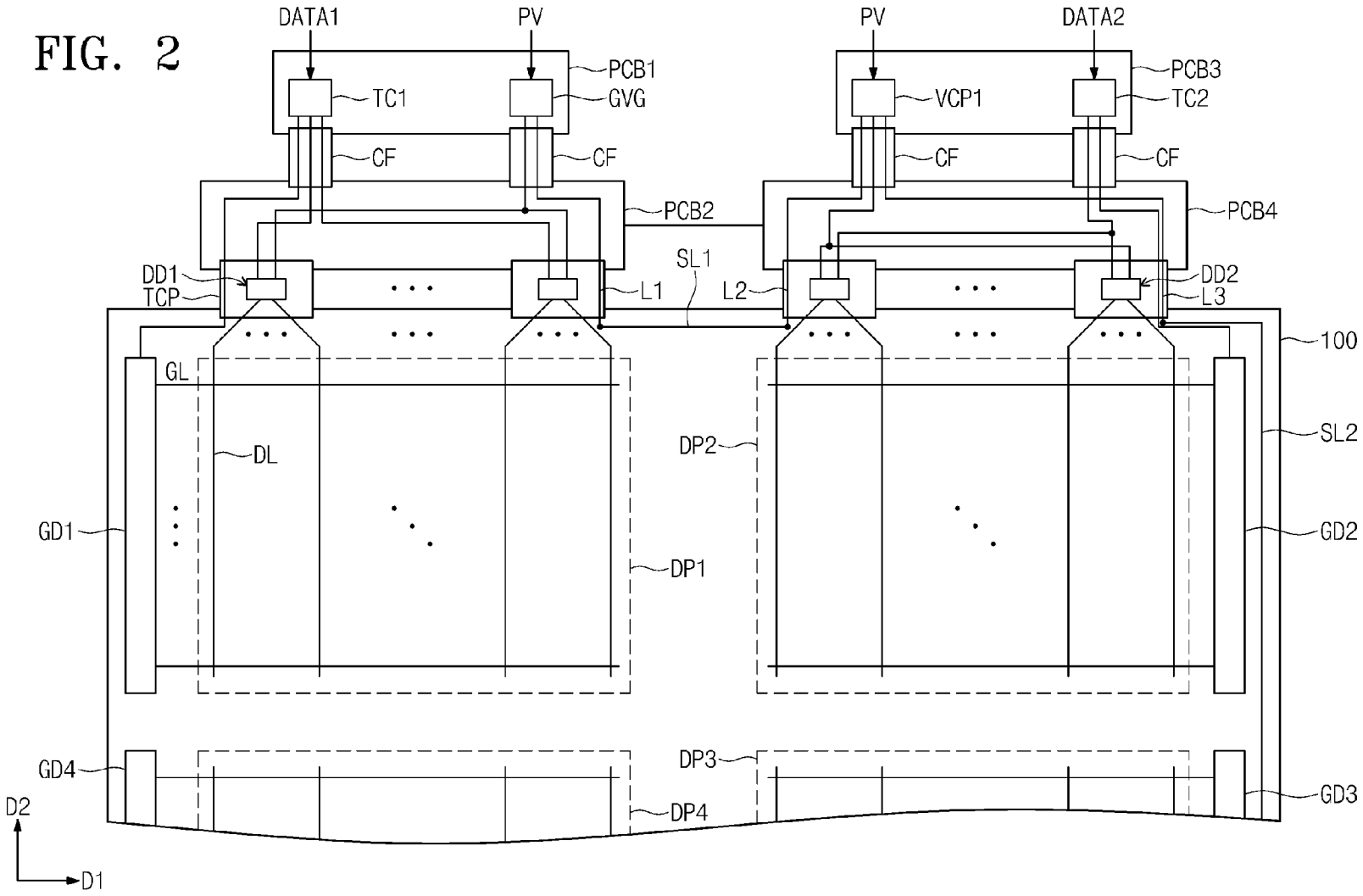
FIG. 2 is a schematic plan view illustrating a portion of a display device according to an embodiment.
Figure 3:
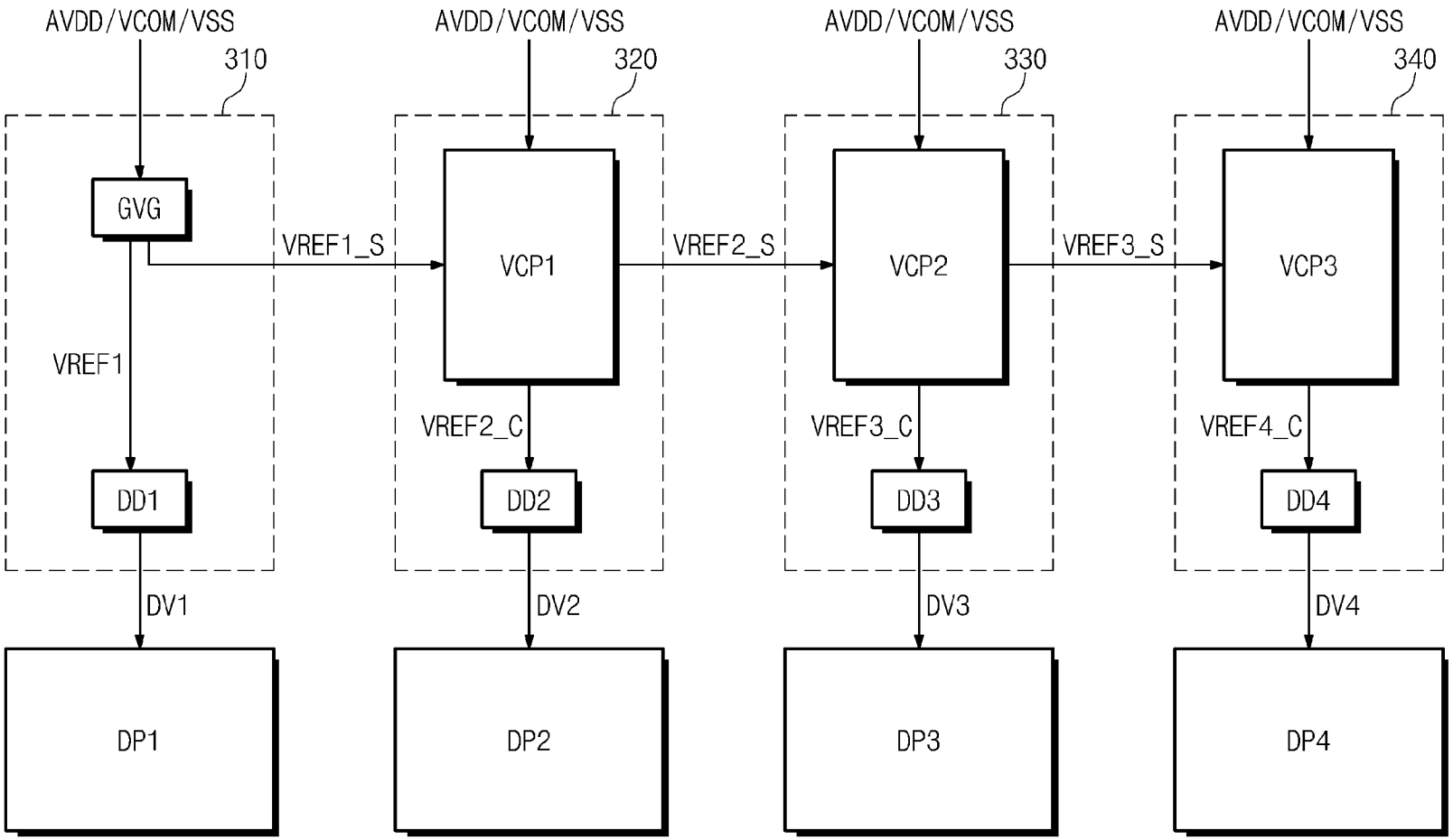
FIG. 3 is a schematic block diagram illustrating a voltage flow of a display device according to an embodiment.

FIG. 2 is a schematic plan view illustrating a portion of a display device according to an embodiment. FIG. 3 is a schematic block diagram illustrating a voltage flow of a display device according to an embodiment. FIG. 4 is a circuit diagram illustrating the voltage compensation unit shown in FIG. 3 according to an embodiment. Referring to FIG. 2, the arrangement and relationships between elements according to an embodiment will be described.

Some of the first timing controller TC1, the first data driver DD1, the first gate driver GD1, and the voltage generation unit GVG forming the first driving block 310 shown in FIG. 1 are disposed on the display panel 100 or a portion of them are disposed adjacent to the display panel.

The first timing controller TC1 and the voltage generation unit GVG are disposed on a first circuit substrate PCB1. Each of the first timing controller TC1 and the voltage generation unit GVG may be an electronic chip placed on the first circuit substrate PCB1.

The first circuit substrate PCB1 is connected to a second circuit substrate PCB2 through a flexible circuit film CF. The flexible circuit film CF includes a plurality of signal wires. Voltages output from the first timing controller TC1 and the voltage generation unit GVG are delivered to the second circuit substrate PCB2 via the flexible circuit film CF.

The second circuit substrate PCB2 is electrically connected to the display panel 100 through a plurality of tape carrier packages TCP. Each of the tape carrier packages TCP includes a flexible circuit film and a driving chip mounted thereon. In this embodiment, the driving chip includes the first data driver DD1.

The first data driver DD1 includes a plurality of driving chips and the plurality of driving chips are respectively mounted on the tape carrier packages TCP, Accordingly, the driving chips operate based on voltages received from the first circuit substrate PCB1.

The first gate driver GD1 is disposed on the display panel 100. However, the described technology is not limited thereto and the gate driver GD1 may be mounted on an additional circuit substrate and electrically connected to the display panel 10 via a flexible film. The first gate driver GD1 operates based on a voltage received from the first circuit substrate PCB1.

The second timing controller TC2, the second data driver DD2, the second gate driver GD2, and the first compensation voltage generation unit VCP1 constituting the second driving block 320 shown in FIG. 1 may be disposed on the display panel 100 or may be arranged adjacent to the display panel.

The second timing controller TC2 and the first compensation voltage generation unit VCP1 are placed on a third circuit substrate PCB3. The second timing controller TC2 and the first compensation voltage generation unit VCP1 can be formed of separate chips and then mounted on the third circuit substrate PCB3.

The third circuit substrate PCB3 is connected to a fourth circuit substrate PCB4 through a flexible circuit film CF. Voltages output from the second timing controller TC2 and the first compensation voltage generation unit VCP1 are delivered to the fourth circuit substrate PCB4 through the flexible circuit film CF.

The fourth circuit substrate PCB4 is electrically connected to the display panel 100 through a plurality of tape carrier packages TCP. The second data driver DD2 includes a plurality of driving chips and the plurality of driving chips can be respectively mounted on the tape carrier packages TCP. Accordingly, the driving chips operate based on voltages received from the third circuit substrate PCB3.

The second gate driver GD2 may be arranged on the display panel 100 in the same manner as the first gate driver GD1 or may be mounted on an additional circuit substrate to be electrically connected to the display panel 100 through a flexible film. Although no shown in the drawing, the third and fourth driving blocks 330 and 340 shown in FIG. 1 may be arranged in the same manner as the second driving block 320.

The display parts DP1 to DP4 forming the display panel 100 are respectively connected to a corresponding data driver and a corresponding gate driver. The first display unit DP1 is connected to the first gate driver GD1 and receives the gate signal from a plurality of gate lines GL extending in the first direction D1.

Additionally, the first display unit DP1 is connected to the first data driver DD1 and receives the data signal through a plurality of data lines DL1 extending in the second direction D2. Each of the display parts DP1 to DP4 includes a plurality of separate gate lines and data lines.

The first driving block 310 and the second driving block 320 are connected to each other through a first share line SL1. The first share line SL1 is disposed on the display panel 100. The first share line SL1 is connected to a tape carrier package TCP connected to the second circuit substrate PCB2 and the other side of the first circuit substrate PCB1 is connected to a tape carrier package TCP connected to the fourth circuit substrate PCB4.

One side of the first share line SL1 is connected to a first line L1. The first line L1 is disposed on the flexible circuit film CF, the second circuit substrate PCB2, and the tape carrier package TCP and includes a plurality of lines electrically connected to each other. The first line L1 electrically connects the voltage generation unit GVG to the first share line SL1.

The other side of the first share line SL1 is connected to a second line L2. The second line L2 is disposed on the tape carrier package TCP, the fourth circuit substrate PCB4, and the flexible circuit film CF and includes a plurality of lines electrically connected to each other. The second line L2 electrically connects the first share line SL1 to the first compensation voltage generation unit VCP1.

The second driving block 320 and the third driving block 330 (see FIG. 1) are connected to each other through a second share line SL2. One side of the second share line SL2 is connected to a line branched from the first compensation voltage generation unit VCP1 of the third circuit substrate PCB3. Although not shown in the drawing, the other side of the second share line SL2 is connected to a line branched from the second compensation voltage generation unit VCP2 of the third driving block 330.

The second share line SL2 is connected to a third line L3. The third line L3 is disposed on the tape carrier package TCP, the fourth circuit substrate PCB4, and the flexible circuit film CF and includes a plurality of lines electrically connected to each other.

The second share line SL2 may be disposed adjacent to the second gate driver GD2. In some embodiments, the second share line SL2 is disposed on the exterior of the second gate driver GD2 and the third gate driver GD3, so as not to intersect gate lines connected to the second gate driver GD2 and gate lines connected to the third gate driver.

The second share line SL2 is disposed on the display panel 100. Although not shown in the drawing, each of the first and second share lines SL1 and SL2 includes at least one line. According to at least one embodiment, an electrostatic phenomenon caused due to the formation of the share lines SL1 and SL2 between circuit substrates is prevented and the display device has increased integration.

Referring to FIG. 3, the flow of a gamma reference voltage in a display device according to an embodiment will be described. A plurality of driving blocks 310 to 340 are shown in FIG. 3 with a timing controller and a gate driver omitted. Additionally, a portion of a plurality of voltages included in the driving voltage PV (see FIG. 1), for example, a first voltage AVDD, a second voltage VCOM, and a third voltage VSS are shown in FIG. 3.

The first driving block 310 outputs a first data signal DV1 based on the first voltage AVDD, the second voltage VCOM, and the third voltage VSS. The first data signal DV1 is delivered to the first display unit DP1 so as to drive it.

The first voltage AVDD has the highest level among driving voltages. The level of the first voltage AVDD may vary in each display panel. The third voltage VSS has a lower level than the first voltage AVDD and the second voltage VCOM has a level between the levels of the first voltage AVDD and the third voltage VSS. For example, the third voltage VSS may be a ground voltage.

The first voltage AVDD, the second voltage VCOM, and the third voltage VSS are input to the voltage generation unit GVG of the first driving block 310. The voltage generation unit GVG generates a first gamma reference voltage VREF1 based on the first voltage AVDD, the second voltage VCOM, and the third voltage VSS. Additionally, the voltage generation unit GVG may further generate other voltages (not shown) but this is omitted in FIG. 3.

The first data driver DD1 outputs the first data signal DV1 based on the first gamma reference voltage VREF1. Although not shown in the drawing, the voltage generation unit GVG includes a plurality of resistors. The voltage generation unit GVG divides a received voltage into a plurality of reference voltages using the resistors, so as to generate the first gamma reference voltage VREF1.

The first gamma reference voltage VREF1 is distributed based on the first voltage AVDD, the second voltage VCOM, and the third voltage VSS. The first gamma reference voltage VREF1 includes a plurality of reference voltages (not shown) relating to an optical transmittance of a plurality of pixels.

In this embodiment, the first gamma reference voltage VREF1 includes 18 reference voltages having 18 voltage levels. The first gamma reference voltage VREF1 includes nine positive reference voltages having a level between the levels of the first voltage AVDD and the second voltage VCOM and nine negative reference voltages having a level between the levels of the second voltage VCOM and the third voltage VSS.

Referring to FIGS. 2 and 3, the first driving block 310 and the second driving block 320 are connected by the first share line SL1 and at least part of the first gamma reference voltage VREF1 is output from the first driving block 310 through the first share line SL1. For example, a first share gamma reference voltage VREF1_S including at least part of the first gamma reference voltage VREF1 is delivered to the second driving block 320 through the first share line SL1.

In this embodiment, the first share gamma reference voltage VREF1_S includes all reference voltages of the first gamma reference voltage VREF1. Accordingly, the first share gamma reference voltage VREF1_S includes the above 18 reference voltages.

The first share line SL1 includes a number of lines which corresponds to the number of reference voltages of the first share gamma reference voltage VREF1_S. Accordingly, in this embodiment, the first share line SL1 includes 18 lines.

The second driving block 320 outputs a second data signal DV2 based on the first voltage AVDD, the second voltage VCOM, and the third voltage VSS. The first voltage AVDD, the second voltage VCOM, and the third voltage VSS may be separated from voltages of the first driving block 310 or may be shared therebetween. The second data signal DV2 is delivered to the second display unit DP2 so as to drive it.

The first compensation voltage generation unit VCP1 included in the second driving block generates a first compensation gamma reference voltage VREF2_C based on the first voltage AVDD, the second voltage VCOM, and the third voltage VSS.

The first compensation gamma reference voltage VREF2_C includes a number of voltages corresponding to the number of voltages of the first gamma reference voltage VREF1. Accordingly, the first compensation gamma reference voltage VREF2_C includes nine positive reference voltages having a level between the that of the first voltage AVDD and the second voltage VCOM and nine negative reference voltages having a level between the that of the second voltage VCOM and the third voltage VSS.

The first compensation voltage generation unit VCP1 generates the first compensation gamma reference voltage VREF2_C based on the first share gamma reference voltage VREF1_S received from the first driving unit 310. Accordingly, the first compensation gamma reference voltage VREF2_C has substantially the same level as the first gamma reference voltage VREF1.

The compensation gamma reference voltage VREF2_C is output to the second data driver DD2. The second data driver DD2 outputs the second data signal DV2 based on the compensation gamma reference voltage VREF2_C.

Accordingly, the second data signal DV2 is generated based on voltages that are substantially the same as the first gamma reference voltage VREF1. Accordingly, the second data signal DV2 has substantially the same voltage level and voltage fluctuations as the first data signal DV1.

In the same manner as shown in FIGS. 1 to 3, the third driving block 330 and the second driving block 320 share voltages and the fourth driving block 340 and the third driving block 330 share voltages.

Similar to the second driving block 320, the third data signal DV3 output from the third driving block 330 to the third display unit DP3 is generated based on a gamma reference voltage VREF3_C which is compensated based on the gamma reference voltage VREF2_S received from the second driving block 320. Additionally, the fourth driving block 340 generates a fourth data signal DV4 based on the gamma reference voltage VREF4_C which is compensated based on the gamma reference voltage VREF3_S received from the third driving block 330.

Thus, according to a display device of at least one embodiment, reference voltages are shared between adjacent display parts. The first gamma reference voltage VREF1 generated from the first driving block 310 is shared by the second to fourth driving blocks 320 to 340. Accordingly, each of the display parts DP1 to DP4 is driven based on the data signals DV1 to DV4 generated based on substantially the same reference voltage. In this way, the display parts DP1 to DP4 reduce voltage deviations resulting from differences in reference voltages between adjacent display parts, such that visible boundaries between the display parts DP1 to DP4 is reduced.

Although not shown in the drawing, share lines formed between the first driving block 310 and the fourth driving block 340 can be further included. Accordingly, the fourth driving block 340 can directly receive the first share gamma reference voltage VREF1_S output from the first driving block 310.

Similarly, the third driving block 330 can receive an electrical signal from the fourth driving block 340. As the electrical signal is delivered, each of the driving blocks cab share voltage information with adjacent driving blocks.

Figure 4A:
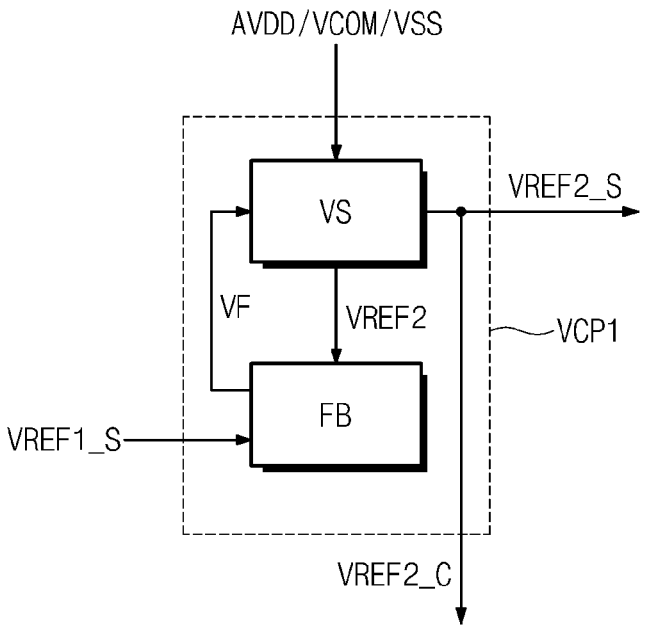
FIG. 4A is a block diagram illustrating a compensation voltage generation unit according to an embodiment.
Figure 4B:
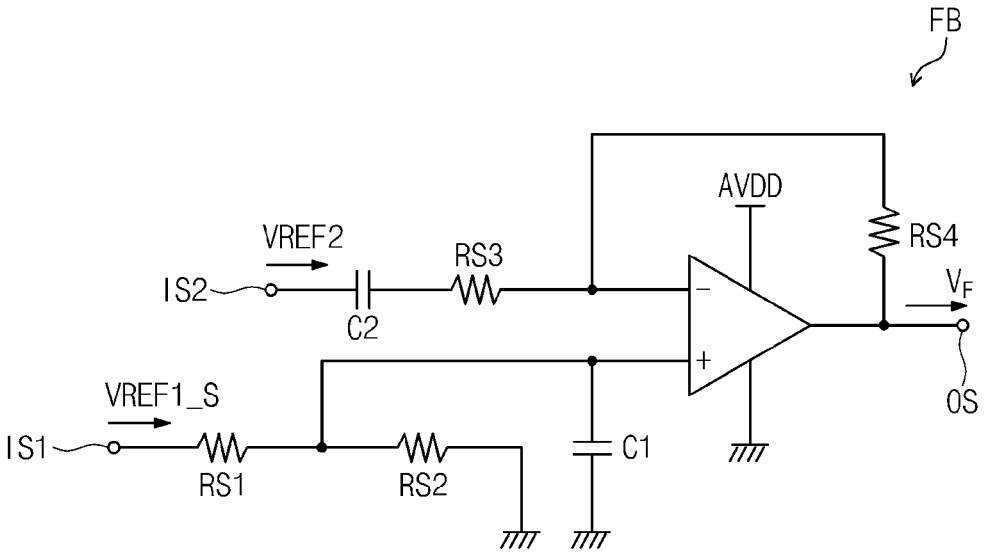
FIG. 4B is a circuit diagram illustrating a partial configuration of the compensation voltage generation unit shown in FIG. 4A according to an embodiment.

FIG. 4A is a block diagram illustrating a compensation voltage generation unit according to an embodiment. FIG. 4B is a schematic circuit diagram illustrating a partial configuration of the compensation voltage generation unit shown in FIG. 4A. Moreover, FIGS. 4A and 4B illustrate the first compensation voltage generation unit VCP1 as one embodiment but this embodiment can equally be applied to the second and third compensation generation parts VCP2 and VCP3 shown in FIG. 3.

Hereinafter, a compensation voltage generation unit including a feedback circuit will be exemplarily described with reference to FIGS. 4A and 4B. The first compensation voltage generation unit VCP1 includes a voltage generation unit or voltage generator VS and a feedback circuit unit or feedback circuit FB.

The voltage generation unit VS generates a second gamma reference voltage VREF2 based on the first voltage AVDD, the second voltage VCOM, and the third voltage VSS received from outside of the first compensation voltage generation unit VCP1. Although not shown in the drawing, the voltage generation unit VS includes a resistor string including a plurality of resistors.

The voltage generation unit VS outputs voltages divided according to the number of resistors included resistor string as the second gamma reference voltage VREF2. The second gamma reference voltage VREF2 includes a number of voltages identical to the number of voltages included in a gamma reference voltage received from the feedback circuit unit FB. In this embodiment, the second gamma reference voltage VREF2 includes 18 reference voltages.

The feedback circuit unit FB receives the first share gamma reference voltage VREF1_S and receives the second gamma reference voltage VREF2 from the voltage generation unit VS. The first compensation voltage generation unit VCP1 generates the first compensation gamma reference voltage VREF2_C by compensating the second gamma reference voltage VREF2 based on the received first share gamma reference voltage VREF1_S.

The second gamma reference voltage VREF2 is received by the feedback circuit unit FB and is compensated based on a gamma voltage output from the first driving block 310. Accordingly, the gamma reference voltage separately generated from the second driving block 320 is compensated to correspond to the gamma reference voltage VREF1 generated from the first driving block 310.

Specifically, the feedback circuit unit FB outputs a feedback signal VF based on the second gamma reference voltage VREF2 and the first share gamma reference voltage VREF1_S. The first compensation voltage generation unit VCP1 outputs a voltage compensated in real time via the feedback circuit unit FB. The feedback signal VF is provided to the voltage generation unit VS and the voltage generation unit VS outputs a voltage adjusted to correspond to the feedback signal VF and delivers it to the feedback circuit unit FB again.

In this embodiment, the feedback circuit unit FB generates feedback based on a voltage difference between the second gamma reference voltage VREF2 and the first share gamma reference voltage VREF1_S. The feedback circuit unit FB includes an operational amplifier OP-AMP, a capacitor C1 and resistors RS1 and RS2 disposed between a non-inverting terminal and a first input terminal IS1. The feedback circuit unit FB also includes a capacitor C2 and a resistor RS3 disposed between an inverting terminal and a second input terminal IS2. The feedback circuit unit FB further includes a resistor RS4 disposed between the non-inverting terminal and an output terminal OS.

The operational amplifier OP-AMP outputs a voltage having a level within a range in which a ground voltage is the minimum and the first voltage AVDD is the maximum. The first share gamma reference voltage VREF1_S, that is, one of the inputs, is delivered to the first input terminal IS1 and is divided by the resistors RS1 and RS2. The divided voltage is applied to a capacitor having a predetermined capacitance C1 and then is input to the non-inverting terminal of the operational amplifier.

The gamma reference voltage VREF2, that is, another input, is delivered to the second input terminal IS2. The second gamma reference voltage VREF2 is input to the inverting terminal through the capacitor C2 and the resistor R3 connected in series.

The output terminal OS outputs the feedback voltage VF. The operational amplifier outputs a value amplified by calculating the difference between the first share gamma reference voltage VREF1_S and the second gamma reference voltage VREF2, as the feedback voltage VF.

Since the feedback voltage VF is fed back to the inverting terminal through the resistor RS4, the operational amplifier continuously compares the feedback voltage VF with the first share gamma reference voltage VREF1_S and outputs an output voltage corresponding to the difference as the feedback voltage VF.

The feedback voltage VF is input to the voltage generation unit VS. The voltage generation unit VS outputs a voltage VREF2 corresponding to the feedback voltage VF based on the received feedback voltage VF. For example, the voltage generation unit VS outputs a voltage adjusted to a lower potential as the feedback voltage becomes higher and outputs a voltage adjusted to a higher potential as the feedback voltage VF becomes lower.

Accordingly, the second gamma reference voltage VREF2 output from the voltage generation unit VS is controlled to another potential value in real time. The second gamma reference voltage VREF2 is input to the feedback circuit unit FB. The feedback circuit unit FB compares the second gamma reference voltage VREF2 and the first share gamma reference voltage VREF1_S and provides a feedback voltage VF different from the previous to the voltage generation unit VS.

By repeating this process, the feedback circuit unit FB adjusts the gamma reference voltage VREF2 generated from the voltage generation unit VS. While the voltage generation unit VS is continuously controlled by the feedback circuit unit FB, after the feedback voltage VF having a level of '0' is received, the voltage generated is output as a compensated second gamma reference voltage VREF2_C without passing through the feedback circuit unit FB.

As a result, the compensated second gamma reference voltage VREF2_C has substantially the same level as the first gamma reference voltage VREF1. Accordingly, by including the feedback circuit unit FB, the first compensation voltage generation unit VCP1 can adjust the gamma voltage generated from the generation unit VS in real time and can provide a voltage compensated to have substantially the same level as the first gamma reference voltage VREF1 to the second driving unit DD2.

Figure 5:
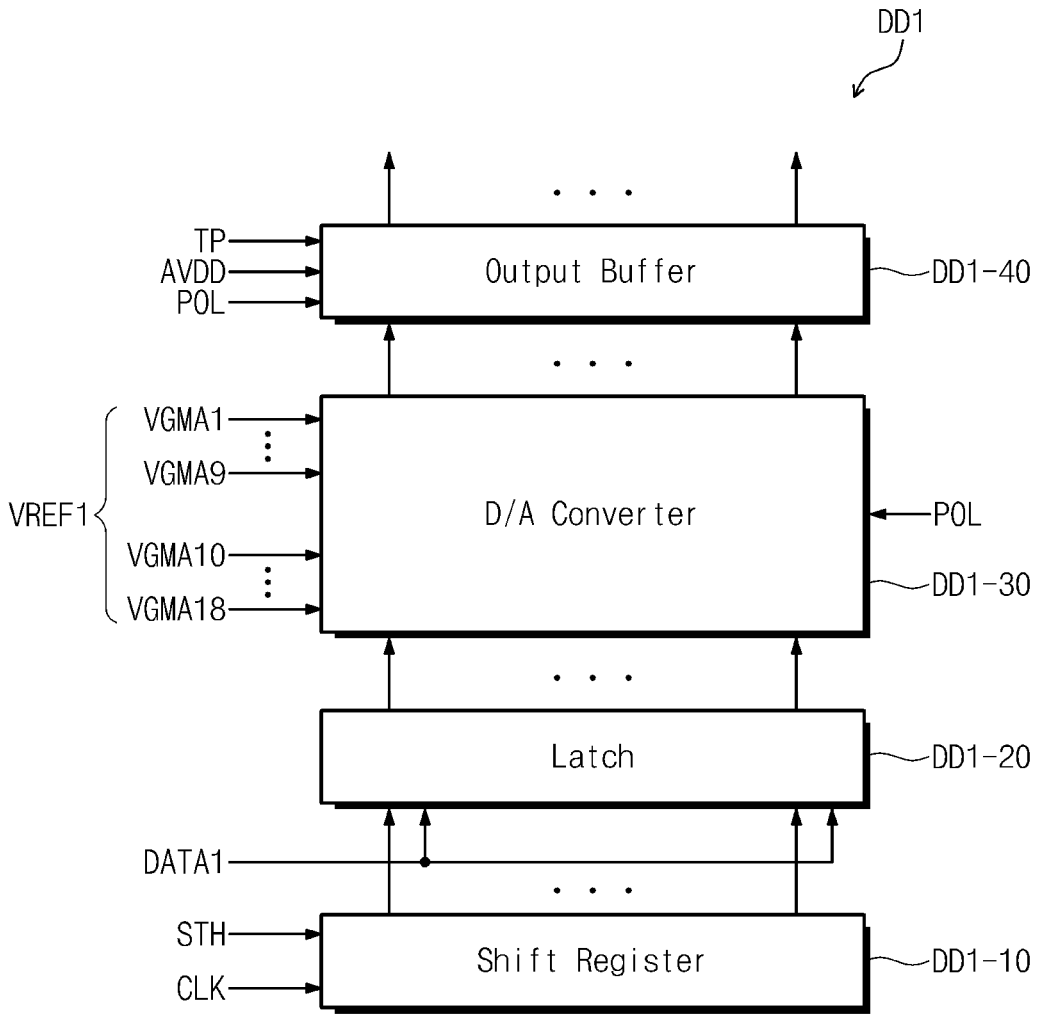
FIG. 5 is a block diagram of the data driver shown in FIG. 3.

FIG. 5 is a block diagram of the data driver shown in FIG. 3. The first data driver DD1 is exemplarily shown in FIG. 5. Although not shown in the drawing, the second to fourth data drivers DD2 to DD4 shown in FIG. 3 may include the same components as the first data driver DD1.

The first data driver DD1 includes a shift register DD1-10, a latch DD1-20, a digital-analog converter DD1-30 (hereinafter referred to as a D/A converter), and an output buffer DD1-40. Hereinafter, same reference numerals are assigned to components overlapping with those in the embodiment of FIG. 3 and their detailed descriptions are omitted.

The shift register DD1-10 includes a plurality of stages (not shown) connected in a cascade. The stages receive a data clock signal CLK. A horizontal start signal STH is applied to the first stage of the stages. Once the operation of the first stage starts based on the horizontal start signal STH, the stages output control signals sequentially in response to the data clock signal CLK.

The latch DD1-20 includes a plurality of latch circuits. The latch circuits receive control signals sequentially from the stages. The latch DD1-20 stores the image data based on a pixel row unit. The latch circuits respectively store corresponding image data in the image data DATA1 in response to each of the control signals. The latch DD1-20 provides the stored image data corresponding to the pixel row to the D/A converter DD1-30.

The D/A converter DD1-30 receives the first gamma reference voltage VREF1. Although not shown in the drawing, the D/A converter DD1-30 may include a plurality of D/A converter circuits corresponding to the latch circuits. The D/A converter DD1-30 converts image data corresponding to the pixel row supplied from the latch DD1-20 into grayscale voltages.

The D/A converter DD1-30 generates positive grayscale voltages from the positive reference voltages VGMA1 to VGMA9 or negative grayscale voltages from negative reference voltages VGMA10 to VGMA18 in response to a polarity control signal POL. The D/A converter DD1-30 outputs the positive grayscale voltages and the negative grayscale voltages alternately by a pixel row unit in response to the polarity control signal POL.

The output buffer DD1-40 receives the grayscale voltages from the D/A converter DD1-30. The output buffer DD1-40 buffers the grayscale voltages and provides them to the display panel 100. The buffered grayscale voltages are the first data signal DV1. The first data signal DV1 may be amplified from the grayscale voltages.

The output buffer DD1-40 outputs a pixel row amount of data signals to an entire corresponding area of a display unit simultaneously in response to an output start signal TP. The output buffer DD1-40 may include a number of buffer circuits equal to the number of data lines, for example.

The output buffer DD1-40 sets a level range of the first data signal DV1 based on the first voltage AVDD, the second voltage VCOM, and the third voltage VSS. For example, the output buffer DD1-40 generates a plurality of positive grayscale voltages having a level between the levels of the first voltage AVDD and the second voltage VCOM. Additionally, the output buffer DD1-40 generates a plurality of negative grayscale voltages having a level between the levels of the second voltage ACOM and the third voltage VSS.

In the same manner, D/A converters included in the second to fourth data drivers DD2 to DD4 respectively receive compensated gamma reference voltages VREF2_C to VREF4_C. The D/A converters included in the second to fourth data drivers DD2 to DD4 output positive and negative grayscale voltages based on the compensated gamma reference voltages VREF2_C to VREF4_C.

Output buffers included in the second to fourth data drivers DD2 to DD4 output positive and negative grayscale voltages generated based on the compensated gamma reference voltages VREF2_C to VREF4_C, as data signals DV2 to DV4. Since the compensated gamma reference voltages VREF2_C to VREF4 have substantially the same level as the first gamma reference voltage VREF1, the second to fourth data drivers DD2 to DD4 output data signals having substantially the same level as the first data signal DV1. Accordingly, a display device according to at least one embodiment reduces the deviation level of a driving signal between the driving blocks 310 to 340 and prevents the boundaries of the display parts DP1 to DP4 from being visible.

Figure 6:
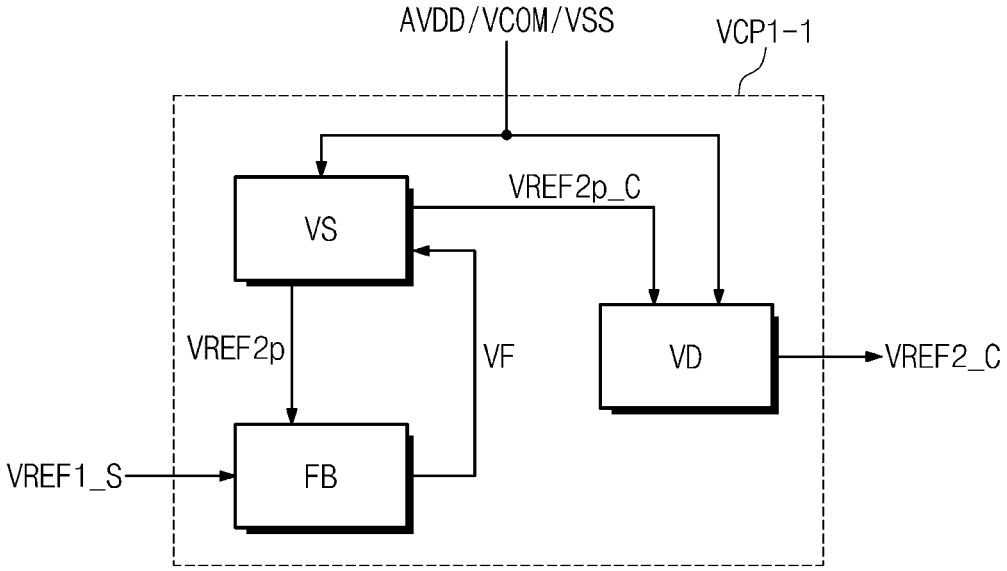
FIG. 6 is a block diagram of a compensation voltage generation unit according to an embodiment.
Figure 7:
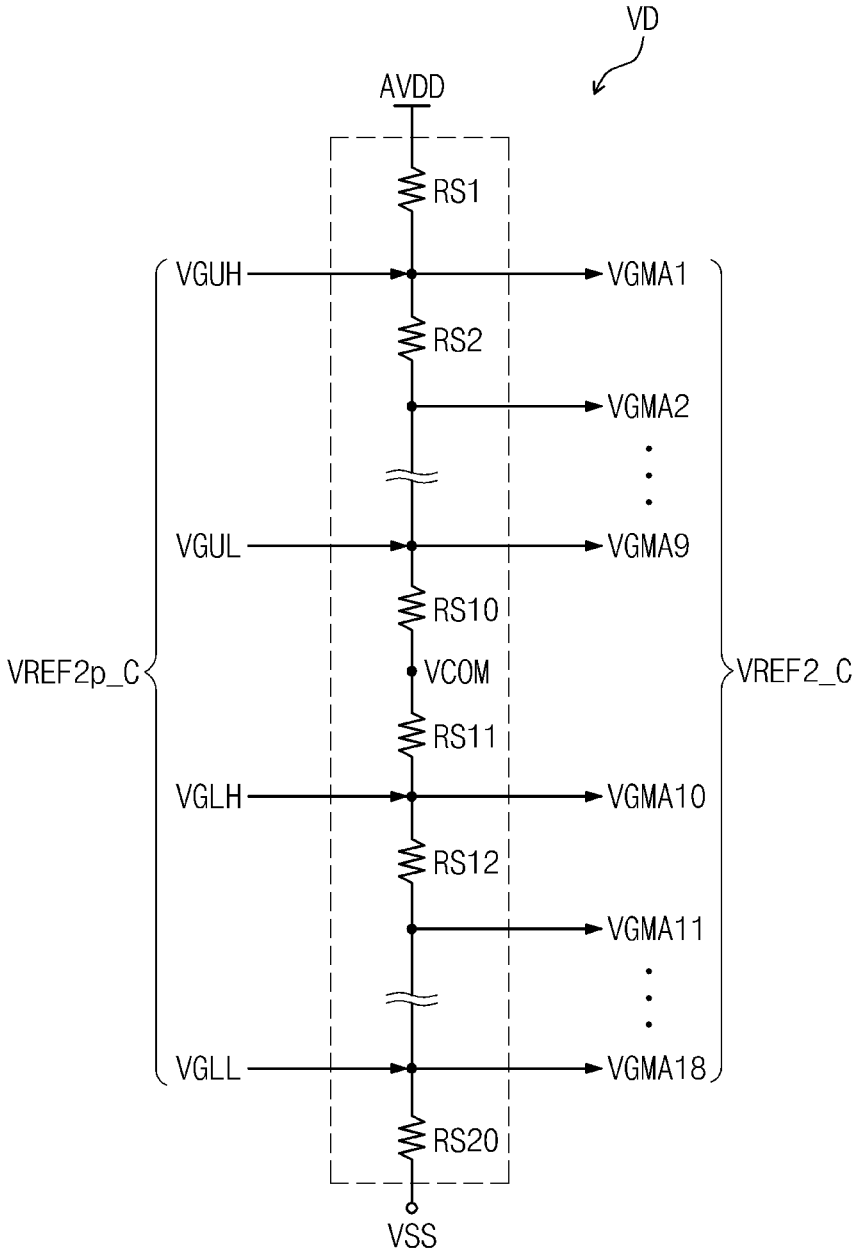
FIG. 7 is a circuit diagram illustrating a partial configuration of the compensation voltage generation unit shown in FIG. 6 according to an embodiment.

FIG. 6 is a block diagram of a compensation voltage generation unit VCP1-1 according to an embodiment. FIG. 7 is a circuit diagram illustrating a partial configuration of the compensation voltage generation unit VCP1-1 according to an embodiment.

FIGS. 6 and 7 illustrate an embodiment in which only part of the first gamma reference voltage VREF1 (see FIG. 3) is shared. As shown in FIGS. 6 and 7, the first compensation voltage generation unit VCP1-1 further includes a voltage distribution unit or voltage distributer DV.

In this embodiment, the voltage generation unit VS generates a gamma reference voltage corresponding to the voltages of the gamma reference voltage VREF1_S received from the first driving block 310. Accordingly, the voltage generation unit VS generates part of a second gamma reference voltage VREF2*p* corresponding to part of the first gamma reference voltage VREF1.

In this embodiment, the first share gamma reference voltage VREF1_S includes a portion of the voltages of the first gamma reference voltage VREF1 shown in FIG. 3. For example, the first share gamma reference voltage VREF1_S includes four voltages including a positive first reference voltage VGUH and a positive second reference voltage VGUL having a level between the first voltage AVDD and the second voltage VCOM. The first share gamma reference voltage VREF1_S further includes a negative first reference voltage VGLH and a negative second reference voltage VGLL having a level between the second voltage VCOM and the third voltage VSS.

The part of the second gamma reference voltage VREF2*p* includes a number of voltages respectively having level differences are identical to those of the gamma reference voltage VREF1_S received from the first driving block 310. Accordingly, the part of the second gamma reference voltage VREF2*p* includes four voltages. Although not shown in the drawing, a second share gamma reference voltage VREF2_S output from the second driving block 320 and input to the third driving block 330 also includes four voltages. Therefore, according to the embodiment shown in FIG. 6, only a subset of the gamma reference voltages are shared between the driving blocks 310 to 340.

In this embodiment, the feedback circuit unit FB outputs a feedback voltage VF based on the first share gamma reference voltage VREF1_S and the part of the second gamma reference voltage VREF2*p*. The voltage generation unit VS output a part of the first compensation gamma reference voltage VREF2*p*_C based on the feedback voltage VF.

The part of the first compensation gamma reference voltage VREF2*p*_C includes a number of voltages identical to the number of the part of the second gamma reference voltage VREF2*p*. Hereinafter, for overlapping descriptions, refer to FIGS. 1 to 5.

The part of the first compensation gamma reference voltage VREF2*p*_C includes a number of voltages identical to the number of voltages shared from the first driving block 310. For example, the part of the first compensation gamma reference voltage VREF2*p*_C includes a positive high gamma reference voltage VGUH, a positive low gamma reference voltage VGUL, a negative high gamma reference voltage VGLH, and a negative low gamma reference voltage VGLL.

The generated part of the first compensation gamma reference voltage VREF2*p*_C is input to the voltage distribution unit or voltage distributer VD. The voltage distribution unit VD divides the received part of the second compensation gamma reference voltage VREF2*p*_C into a plurality of voltages. The plurality of divided voltages forms a second compensation gamma reference voltage VREF2_C.

The voltage distribution unit VD includes a plurality of resistors RS1 to RS20, which are connected in series between the first voltage AVDD and the second driving voltage VCOM and connected in series between the second voltage VCOM and the third voltage VSS. The part of the second compensation gamma reference voltage VREF2*p*_C input to the voltage distribution unit VD is connected to the corresponding position of the distributor.

For example, the voltage distribution unit VD generates nine positive reference voltages VGMA1 to VGMA9 based on the positive high gamma reference voltage VGUH and the positive low gamma reference voltage VGUL. The nine positive reference voltages VGMA1 to VGMA9 include a first reference voltage VGMA1 corresponding to the positive high gamma reference voltage VGUH, a ninth reference voltage VGMA9 corresponding to the positive low gamma reference voltage VGUL, and seven positive reference voltages VGMA2 to VGMA8 divided from levels between the positive high gamma reference voltage VGUH and the positive low gamma reference voltage VGUL.

Additionally, the voltage distribution unit VD generates nine negative reference voltages VGMA10 to VGMA18 based on the negative high gamma reference voltage VGLH and the negative low gamma reference voltage VGLL. The nine negative reference voltages VGMA10 to VGMA18 include a tenth reference voltage VGMA10 corresponding to the negative high gamma reference voltage VGLH, an eighteenth reference voltage VGMA18 corresponding to the negative low gamma reference voltage VGLL, and seven negative reference voltages VGMA11 to VGMA17 divided from levels between the negative high gamma reference voltage VGLH and the negative low gamma reference voltage VGLL.

In this embodiment, the first compensation gamma reference voltage VREF2_C includes 18 reference voltages. However, the described technology is not limited thereto and thus the number of the gamma voltages outputted may be adjusted by diversely changing the number of the resistors in the distributor. The first compensation gamma reference voltage VREF2_C includes a number of voltages identical to the number of voltages of the first gamma reference voltage VREF1 generated from the first driving block 310.

Therefore, according to at least one embodiment, even when only parts of voltages of the first gamma reference voltage VREF1 are shared, all voltages of the first gamma reference voltage VREF1 are substantially shared. Accordingly, the number of share lines connecting between the driving blocks 310 to 340 can be reduced so that the area occupied by the share lines is reduced, processes for forming the lines are simplified, and manufacturing thereof is also simplified.

Figure 8:
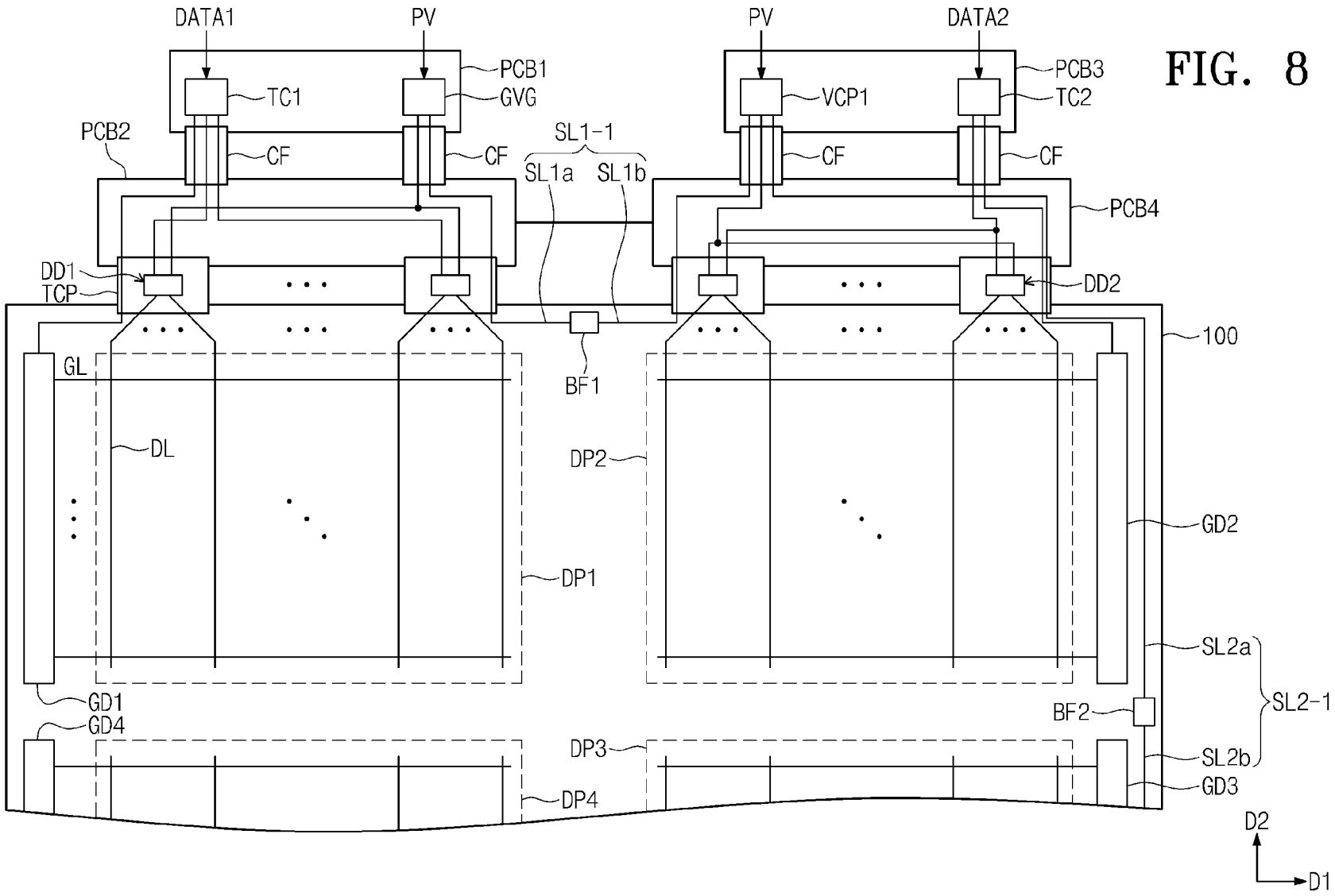
FIG. 8 is a plan view illustrating part of a display device according to an embodiment.

FIG. 8 is a schematic block diagram illustrating part of a display device according to an embodiment. Moreover, the same reference numerals are assigned to the same configuration as that described with reference to FIGS. 1 to 7 and overlapping descriptions are omitted.

A display device according to an embodiment further includes buffer parts or buffers BF1 and BF2. Each of the buffer parts BF1 and BF2 includes at least one operational amplifier OP-Amp having a gain of 1. Each of the buffer parts BF1 and BF2 buffers a received voltage fully and then outputs it.

The buffer parts BF1 and BF2 are arranged between the driving blocks 310 to 340. For example, the buffer unit BF1 and BF2 are arranged between the first driving block 310 and the second driving block, between the second driving block 320 and the third driving block 330, and/or between the third driving block 330 and the fourth driving block 340. In this embodiment, the buffer parts BF1 and BF2 include a first buffer unit BF1 and a second buffer unit BF2.

The first buffer unit BF1 is disposed on the display panel 100. The first buffer unit BF1 is located between the first driving block 310 and the second driving block 320, so that it buffers a first share gamma reference voltage VREF1_S applied from the first driving block 310 to the first share line SL1-1. The first share line SL1-1 includes a first sub-share line SL1*a* and a second sub-share line SL1*b*.

The first sub-share line SL1*a* connects the first driving block 310 to the first buffer unit BF1. Accordingly, the first share gamma reference voltage VREF1_S can be delivered to the first sub-share line SL1*a*.

The second sub-share line SL1*b* connects the first buffer unit BF1 to the second driving block 320. Accordingly, the buffered gamma reference voltage can be delivered to the second sub-share line SL1*b*.

The buffered gamma reference voltage has substantially the same voltage level as the first share gamma reference voltage VREF1_S. By further including the first buffer unit BF1, the display device according to an embodiment can prevent voltage drop of the first share gamma reference voltage VREF1_S according to an internal resistance of the first share line SL1. Accordingly, the second driving block 320 can generate the second data signal DV2 based on a gamma reference voltage having substantially the same level as the first gamma reference voltage VREF1.

The second buffer unit BF2 is arranged adjacent to the second gate driver GD2. The second buffer unit BF2 may be disposed on the display panel 100. The second buffer unit BF2 is located between the display unit DP2 and the third display unit DP3. However, the described technology is not limited thereto and when the second gate driver GD2 is mounted on an additional circuit substrate to be electrically connected to the display panel 100 through a flexible film, the second buffer unit BF2 can be disposed on the additional circuit substrate.

The second buffer unit BF2 is arranged between the second driving block 320 and the third driving block 330 (see FIG. 1), so that it buffers a second share gamma reference voltage VREF2_S applied from the second driving block 330 to the second share line SL2-1. The second share line SL2-1 includes a third sub-share line SL2*a* and a fourth sub-share line SL2*b*.

The third sub-share line SL2*a* connects the second driving block 320 to the second buffer unit BF2. Accordingly, the second share gamma reference voltage VREF2_S can be delivered to the third sub-share line SL2*a*.

The fourth sub-share line SL2*b* connects the second buffer unit BF2 to the third driving block 330. Accordingly, the buffered gamma reference voltage can be delivered to the fourth sub-share line SL2*b*.

The second share line SL2 delivers a gamma reference voltage buffered through the second buffer unit BF2 to the third driving block 330. According thereto, a gamma reference voltage delivered to the third driving block 330 has substantially the same level as a voltage output from the first compensation voltage generation unit VCP1 of the second driving block 320.

In some embodiments, a plurality of second buffer units BF2 are provided. The second buffer parts BF2 are arranged adjacent to the second gate driver GD2 and the third gate driver (not shown). For example, the second buffer parts BF2 may be arranged on the exterior of the second gate driver GD2 and the third gate driver (not shown).

In these embodiments, the second share line SL2 is arranged on the exterior of the second gate driver GD2 and the third gate driver (not shown), so as not to intersect the gate lines extending from the second gate driver GD2 and the third gate driver (not shown) to the second display unit DP2 and the third display unit DP3.

Although not shown in the drawing, the share lines connecting each of the driving blocks 310 to 340 include a predetermined internal resistance. For example, the first share line SL1 includes a predetermined internal resistance. Accordingly, in relation to the first share gamma reference voltage VREF1_S, the voltage drops due to the internal resistance when transmitted through the first share line SL1.

Accordingly, a gamma reference voltage that the second driving block 320 receives has a lower level than the first share gamma reference voltage VREF1_S. When the voltage-dropped gamma reference voltage is received, the data voltage output from the second driving block 320 and the data voltage output from the first driving block 310 may be generated based on different voltage levels.

The first buffer unit BF1 buffers the first share gamma reference voltage VREF1_S passing through the first share line SL1, so as to prevent a voltage drop along the first share line SL1 due to its internal resistance. Accordingly, the first compensation voltage generation unit VCP1 receives a gamma reference voltage having substantially the same level as the first share gamma reference voltage VREF1_S and as a result, generates a gamma reference voltage having substantially the same level as the first gamma reference voltage VREF1.

Additionally, the second buffer unit BF2 buffers the second share gamma reference voltage VREF2_S passing through the second share line SL2, so as to prevent voltage drop due to internal resistance of the second share line SL2. Accordingly, the third driving block 330 receives a gamma reference voltage having substantially the same level as the second share gamma reference voltage VREF2_S and as a result, generates a gamma reference voltage having substantially the same level as the first gamma reference voltage VREF1.

Figure 9:
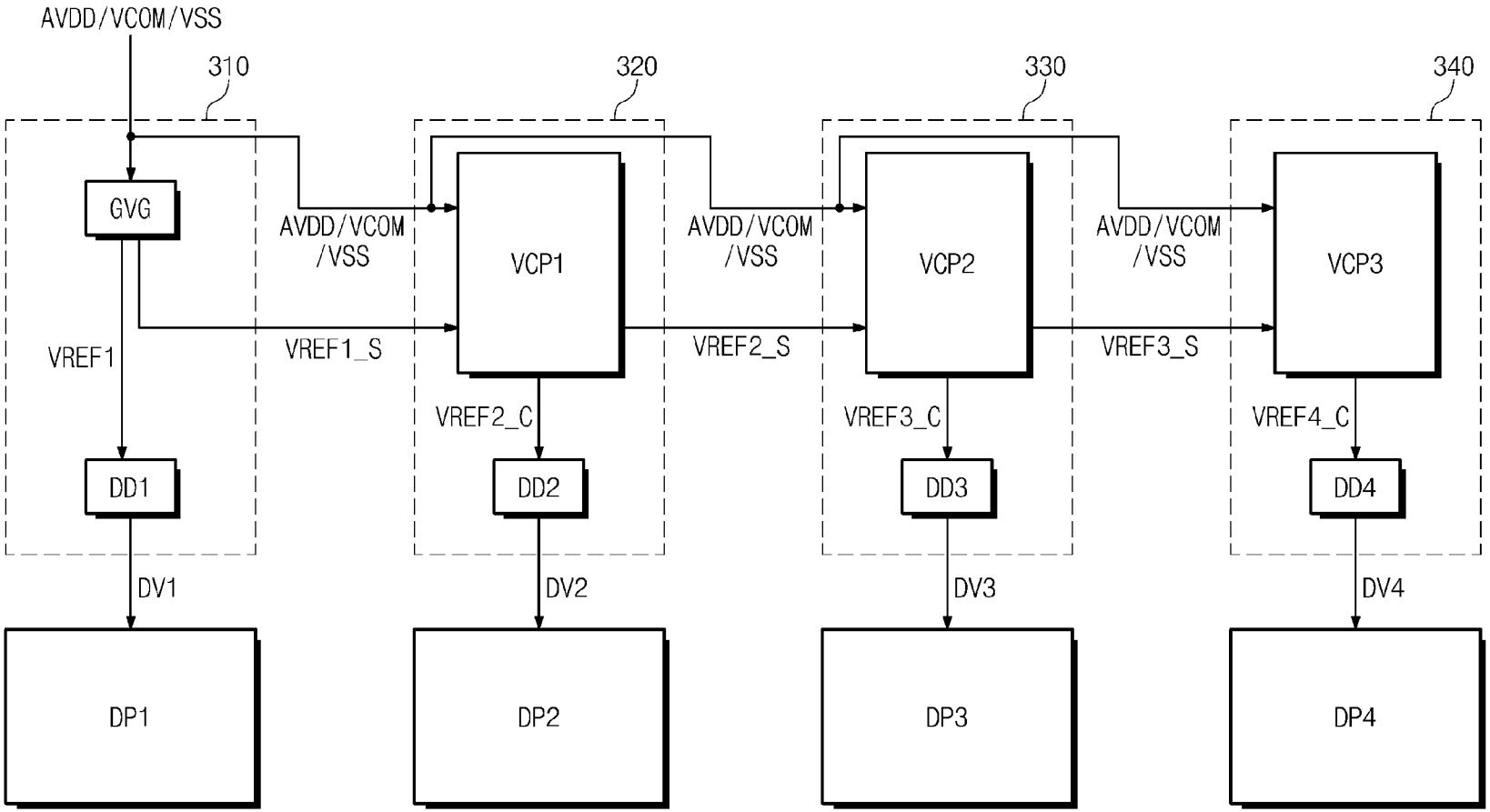
FIG. 9 is a schematic block diagram illustrating a voltage flow of a display device according to an embodiment.

FIG. 9 is a schematic block diagram illustrating a voltage flow of a display device according to an embodiment. The embodiment of FIG. 9 is identical to the embodiment of FIG. 3 except that driving voltage in FIG. 9 is also shared. Accordingly, compared to the embodiment of FIG. 3, the differences will be mainly described and detailed description for the same configuration as that shown in FIG. 3 will be omitted.

The first to fourth driving blocks 310 to 340 according to an embodiment may further share the driving voltage. The driving voltage includes a first voltage AVDD, a second voltage VCOM, and a third voltage VSS.

The voltage generation unit GVG of the first driving block 310 generates a first gamma reference voltage VREF1 by receiving a driving voltage AVDD/VCOM/VSS from an external power source. At this point, the second driving block 320 receives the first share gamma reference voltage VREF1_S and the driving voltage AVDD/VCOM/VSS from the first driving block 310. The first share gamma reference voltage VREF1_S and the driving voltage AVDD/VCOM/VSS are delivered through the first share line SL1 (see FIG. 2).

The first share gamma reference voltage VREF1_S includes at least part of reference voltages of the first gamma reference voltage VREF1 and the driving voltage AVDD/VCOM/VSS has substantially the same level as the driving voltage AVDD/VCOM/VSS received by the voltage generation unit GVG. Accordingly, the second driving block 320 outputs a second data signal DV2 based on the driving voltage AVDD/VCOM/VSS received by the first driving block 310 and the first share gamma reference voltage VREF1_S.

A second share gamma reference voltage VREF2_S including substantially the same voltages as the first share gamma reference voltage VREF1_S and the driving voltage AVDD/VCOM/VSS are delivered to the third driving block 330. The second share gamma reference voltage VREF2_S and the driving voltage AVDD/VCOM/VSS are delivered through the second share line SL2 (see FIG. 2).

The third driving block 330 and the fourth driving blocks 340 are driven in the same manner as the second driving block 320. Accordingly, the first to fourth gamma reference voltages VREF1 to VREF4 are generated based on a voltage that is substantially identical the driving voltage AVDD/VCOM/VSS received by the first driving block 310. As a result, the first to fourth driving blocks 310 to 340 drive the display parts DP1 to DP4 by using a driving signal generated based on substantially the same voltages, so that a visible boundary defect due to a voltage deviation and a brightness difference between the display parts DP1 to DP4 is prevented.

According to at least one embodiment, a display device includes first and second display parts and includes first and second driving blocks respectively applying driving signals to the first and second display parts. The second driving block generates a data signal based on a gamma reference voltage generated from the first driving block and provides the generated data signal to the second display unit. Accordingly, the second display unit is driven based on substantially the same gamma reference voltage as that of the first display unit, so that a visible boundary defect between the first display unit and the second display unit is prevented.

The above-disclosed subject matter is to be considered illustrative and not restrictive, and the appended claims are intended to cover all such modifications, enhancements, and other embodiments, which fall within the true spirit and scope of the inventive technology. Thus, to the maximum extent allowed by law, the scope of the invention is to be determined by the broadest permissible interpretation of the following claims and their equivalents, and shall not be restricted or limited by the foregoing detailed description.

What is claimed is:

1. A display device, comprising:

a display panel divided into a first display part and a second display part adjacent to the first display part;

a first driving circuit configured to: i) receive a driving voltage, ii) generate a first gamma reference voltage based on the driving voltage, iii) generate a first data signal based on the first gamma reference voltage, and iv) apply the first data signal to the first display part;

a second driving circuit configured to apply a second data signal to the second display part; and a first share line disposed on the display panel and configured to receive the first gamma reference voltage, wherein the second driving circuit is further configured to: i) receive the first gamma reference voltage from the first share line and ii) generate the second data signal based on the first gamma reference voltage, and wherein the second driving circuit comprises:

a compensation voltage generator configured to generate a first compensation gamma reference voltage having a voltage level corresponding to that of the first gamma reference voltage based on the first gamma reference voltage; and a second data driver configured to generate the second data signal based on the first compensation gamma reference voltage.

2. The display device of claim 1, wherein the compensation voltage generator comprises:

a voltage generator configured to generate a second gamma reference voltage; and a feedback circuit configured to output a feedback signal based on the voltage difference between the first gamma reference voltage and the second gamma reference voltage.

3. The display device of claim 2, wherein the first gamma reference voltage comprises a positive first reference voltage, a positive second reference voltage, a negative first reference voltage, and a negative second reference voltage.

4. The display device of claim 3, wherein the first gamma reference voltage further comprises: i) a plurality of positive reference voltages having voltage levels between those of the positive first reference voltage and the positive second reference voltage and ii) a plurality of negative reference voltages having voltage levels between those of the negative first reference voltage and the negative second reference voltage.

5. The display device of claim 4, wherein the second data driver is further configured to generate the second data signal based on the positive first reference voltage, the positive second reference voltage, the positive reference voltages, the negative first reference voltage, the negative second reference voltage, and the negative reference voltages.

6. The display device of claim 3, wherein the compensation voltage generator further comprises a voltage distributer configured to generate: i) a plurality of positive reference voltages based on the positive first reference voltage and the positive second reference voltage and ii) a plurality of negative reference voltages based on the negative first reference voltage and the negative second reference voltage.

7. The display device of claim 2, wherein the first driving circuit is further configured to output the driving voltage to the first share line and wherein the voltage generator is further configured to: i) receive the driving voltage from the first share line and ii) generate the second gamma reference voltage based on the driving voltage.

8. The display device of claim 1, further comprising at least one buffer configured to buffer the first gamma reference voltage, wherein the first share line comprises: i) a first sub-share line electrically connecting the first driving circuit to the buffer and ii) a second sub-share line electrically connecting the buffer to the second driving circuit.

9. The display device of claim 8, wherein the buffer is disposed on the display panel.

10. The display device of claim 1, wherein the display panel further comprises a third display part adjacent to the second display part, the display device further comprising:

a third driving circuit adjacent to the third display part and opposing the second driving circuit with the display panel disposed therebetween, wherein the third driving circuit is configured to apply a third data signal to the third display part; and a second share line electrically connecting the second driving circuit to the third driving circuit, wherein the second share line is disposed on the display panel, and wherein the third driving circuit is further configured to: i) receive the first compensation gamma reference voltage from the second share line ii) generate a second compensation gamma reference voltage having a voltage level corresponding to that the first gamma reference voltage based on the first compensation gamma reference voltage and iii) generate the third data signal based on the second compensation gamma reference voltage.

11. The display device of claim 10, wherein the second driving circuit further comprises a second gate driver configured to apply a gate signal to the second display part, wherein the third driving circuit further comprises a third gate driver configured to apply a gate signal to the third display part, and wherein the second share line is adjacent to the second gate driver and the third gate driver.

12. The display device of claim 11, further comprising at least one buffer configured to buffer the first compensation gamma reference voltage applied to the second share line, wherein the second share line comprises: i) a first sub-share line electrically connecting the second driving circuit to the buffer and ii) a second sub-share line electrically connecting the buffer to the third driving circuit.

13. The display device of claim 12, wherein a voltage level of the second compensation gamma reference voltage is substantially the same as a voltage level of the first gamma reference voltage.

* * * * *